United States Patent [19]

Neeman et al.

[11] Patent Number: 5,014,681

[45] Date of Patent: May 14, 1991

[54] METHOD AND APPARATUS FOR APPLYING INTERMITTENT COMPRESSION TO A BODY PART

[75] Inventors: Avraham Neeman, Karkur, Israel; Johannes H. Broeren, El Bovenkarspel, Netherlands

[73] Assignee: Mego Afek Industrial Measuring Instruments, Doar Na, Israel

[21] Appl. No.: 347,706

[22] Filed: May 5, 1989

[51] Int. Cl.[5] ..... A61H 9/00

[52] U.S. Cl. ..... 128/64; 128/24 R; 128/DIG. 20

[58] Field of Search ..... 128/24 R, 44, 64, DIG. 22, 128/DIG. 20, DIG. 12

[56] References Cited

U.S. PATENT DOCUMENTS

| | | | |
|---|---|---|---|
| 2,781,041 | 2/1957 | Weinberg | 128/24 R |
| 4,013,069 | 3/1977 | Hasty | 128/24 R |
| 4,156,425 | 5/1979 | Arkans | 128/24 R |
| 4,338,923 | 7/1982 | Gelfor et al. | 128/24 R |
| 4,762,121 | 8/1988 | Shienfeld | 128/64 |

FOREIGN PATENT DOCUMENTS

| | | | |
|---|---|---|---|
| 1175948 | 6/1957 | France | 128/24 R |
| 2246260 | 10/1973 | France | 128/24 R |

*Primary Examiner*—Edgar S. Burr
*Assistant Examiner*—Lisa E. Malvaso
*Attorney, Agent, or Firm*—Browdy and Neimark

[57] ABSTRACT

A method and apparatus for treating a body part by applying an intermittent compression thereto using for this purpose an inflatable sleeve applied to and enclosing the body part and divided into successively overlapping inflatable cells, pressurized fluid being applied cyclically to successive groups of cells, so as successively to inflate each group while, at the same time, at least partially deflating the preceding group, and ensuring simultaneous deflation of all cells for a minimal time period between successive cycles. The invention also relates to a particular construction of the sleeve.

6 Claims, 7 Drawing Sheets

METHOD AND APPARATUS FOR APPLYING INTERMITTENT COMPRESSION TO A BODY PART

FIELD OF THE INVENTION

This invention relates to apparatus for applying intermittent compression to a body part such as an upper or lower limb, for example for the purpose of stimulating blood flow in the limb so as to prevent pooling or stasis of blood in a bedridden patient or, alternatively for the purpose of treating edema, i.e. the excessive accumulation of fluid in body tissues.

BACKGROUND OF THE INVENTION

It is known to apply such intermittent compression to an upper or lower limb by means of an inflatable sleeve made of a flexible material and divided into a plurality of internal inflatable cells extending along one dimension of the sleeve, each of the cells including a port for inletting and outletting fluid with respect thereto, thereby to individually inflate or deflate the cells, the sleeve being applicable to the limb to be treated so as to enclose it with the inflatable cells extending annularly around the sleeve and the limb. Such sleeves are, for example, disclosed in U.S. Pat. Nos. 2,781,041, 4,013,069, 4,156,425 and 4,338,923 as well as in French patent specification Nos. 1175948 and 2246260.

With sleeves of this kind, inflating means are provided for applying a pressurized fluid to the ports in accordance with a predetermined sequence for the inflation and deflation of the internal cells. The predetermined sequence is controlled by a suitable distributor through which the pressure source is coupled to the ports, whereby the cells are inflated or deflated in accordance with a predetermined sequence.

In all cases hitherto, the predetermined sequences of inflation and deflation of the sleeve cells involve a stage where all cells are simultaneously inflated so that, during that stage, the limb is subjected to compression along its entire length and at least the initially inflated cells remain inflated during the entire cycle so that the portion of the limb surrounded by these initially inflated cells are continuously subjected to compression during the entire cycle.

SUMMARY OF THE INVENTION

It is an object of the present invention to provide a new and improved method and apparatus for treating a body part by the intermittent application of pressure thereto.

It is also an object of the present invention to provide a new and improved inflatable sleeve for treatment of body parts.

According to the present invention there is provided a method of treating a body part by applying an intermittent compression thereto using for this purpose an inflatable sleeve divided into n successively overlapping inflatable cells extending along one dimension of the sleeve wherein $n>6$ comprising the steps of:

applying said sleeve to said body part to enclose same with said inflatable cells extending along one dimension of the sleeve; and applying cyclically a pressurized fluid to successive groups of cells, wherein each group comprises m successive cells wherein $1 \leqq m \leqq 2$, so as successively to inflate each group whilst, at the same time, at least partially deflating the preceding group; and ensuring simultaneous deflation of all cells for a minimal time period between successive cycles.

Thus, by virtue of the fact that discrete groups of cells are inflated whilst the remaining cells are deflated, a compressive wave is induced in the sleeve, this wave travelling in a desired direction with successive portions of the body part being subjected to compression. Thus, during the course of a cycle when all the cells of the sleeve are successively inflated and deflated, any particular region of the body part being treated is only subjected to compression for a fraction of the cycle duration. By virtue of this fact, the discomfort felt by the patient during the course of treatment is considerably reduced as compared with the discomfort experienced when the body part being treated is subjected to compression along the entire length thereof. This reduction in relative discomfort also allows, where necessary, for the cells to be inflated to a higher pressure, thereby increasing the momentary compression exerted on the body part.

Preferably, at least some of the cells are partially deflated by placing the cells to be deflated, being immediately upstream of the group being inflated, into communication with the cell immediately downstream of the group being inflated. In this way, some of the compressed fluid serving to inflate a cell is transferred to a subsequent downstream cell and serves partially to inflate that downstream cell with a consequent economy in the energy required to generate the compressed fluid.

In order to carry out the method in accordance with the invention, there is provide a distributor comprising stationary and rotary members having respective first and second juxtaposed, substantially planar surfaces, said first planar surface being grooved so as to define with said second planar surface a stationary pressure chamber;

a pressurized fluid inlet port formed in said stationary member and communicating with said pressure chamber;

a plurality of pressurized fluid outlet ports formed in said stationary member so as to surround said stationary pressure chamber;

said second planar surface being grooved so as to define, with said first planar surface;

a rotary distributor chamber which communicates, at an inner end thereof, with said first pressure chamber and, at an outer portion thereof, with successive outlet ports;

a by-pass chamber serving to effect communication between an outlet port immediately outside a downstream edge of said distributor chamber and an outlet port immediately outside an upstream edge of said distributor chamber; and a venting chamber communicating with a venting port formed in said rotary member and adapted to communicate successively with each outlet port subsequent to their communication with said by-pass chamber.

In accordance with a particular aspect of the present invention, there is provided an inflatable sleeve of flexible material for the treatment of body parts, which sleeve is divided into a plurality of internal inflatable cells extending alone one dimension of the sleeve, each of the cells including a port for inletting and outletting the fluid with respect thereto, thereby to individually inflate or deflate the cells;

the sleeve being applicable to the body part to be treated to enclose same with the inflated cells extending annularly around the sleeve;

characterized in that said sleeve comprises an outer, flexible envelope and first and second pairs of resilient sheets located within said envelope, the component sheets of each pair being bonded together at successive, transversely directed bonding portions which are uniformly spaced apart along the longitudinal extent of the sleeve so as to define first and second sets of transversely directed cells formed respectively between said first and second pairs of sheets, said first set of cells being staggered with respect to said second set of cells so as to partially overlap said second set;

each cell being provided with a tubular connector extending from the cell port, the tubular connectors of the first set extending directly through said envelope whilst the tubular connectors of the second set extend through said envelope via respective bonded portions of the first pair of sheets, the tubular connectors of said first and second sets respectively alternating with each other.

BRIEF DESCRIPTION OF THE DRAWINGS

For a better understanding of the present invention and to show how the same may be put into practice, reference will now be made to the accompanying drawings, in which.

DETAILED DESCRIPTION OF PREFERRED EMBODIMENTS IN ACCORDANCE WITH VARIOUS ASPECTS OF THE INVENTION

Figure 1:
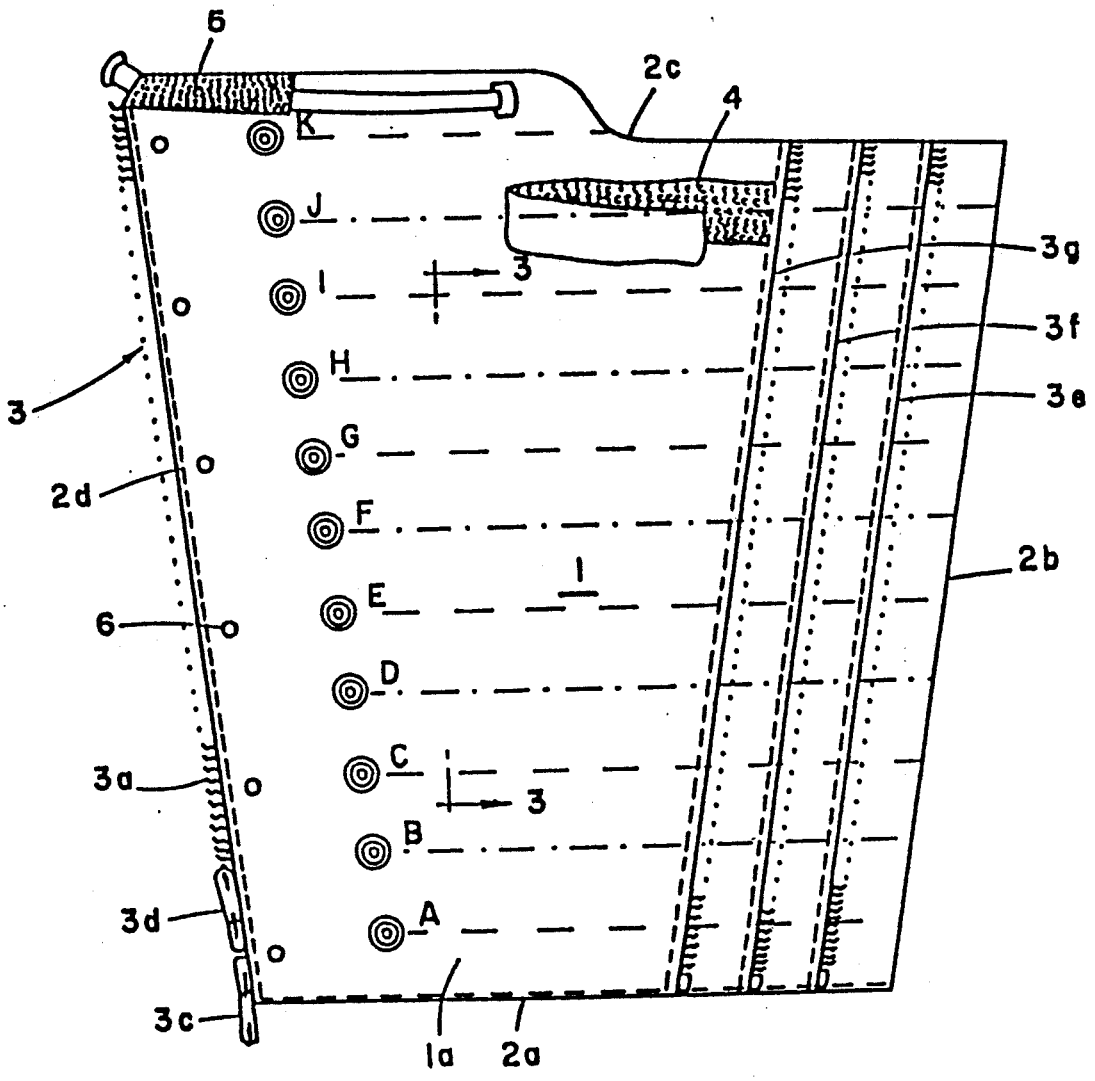
FIG. 1 is a side elevation of an inflatable sleeve in accordance with one aspect of the invention.
Figure 2:
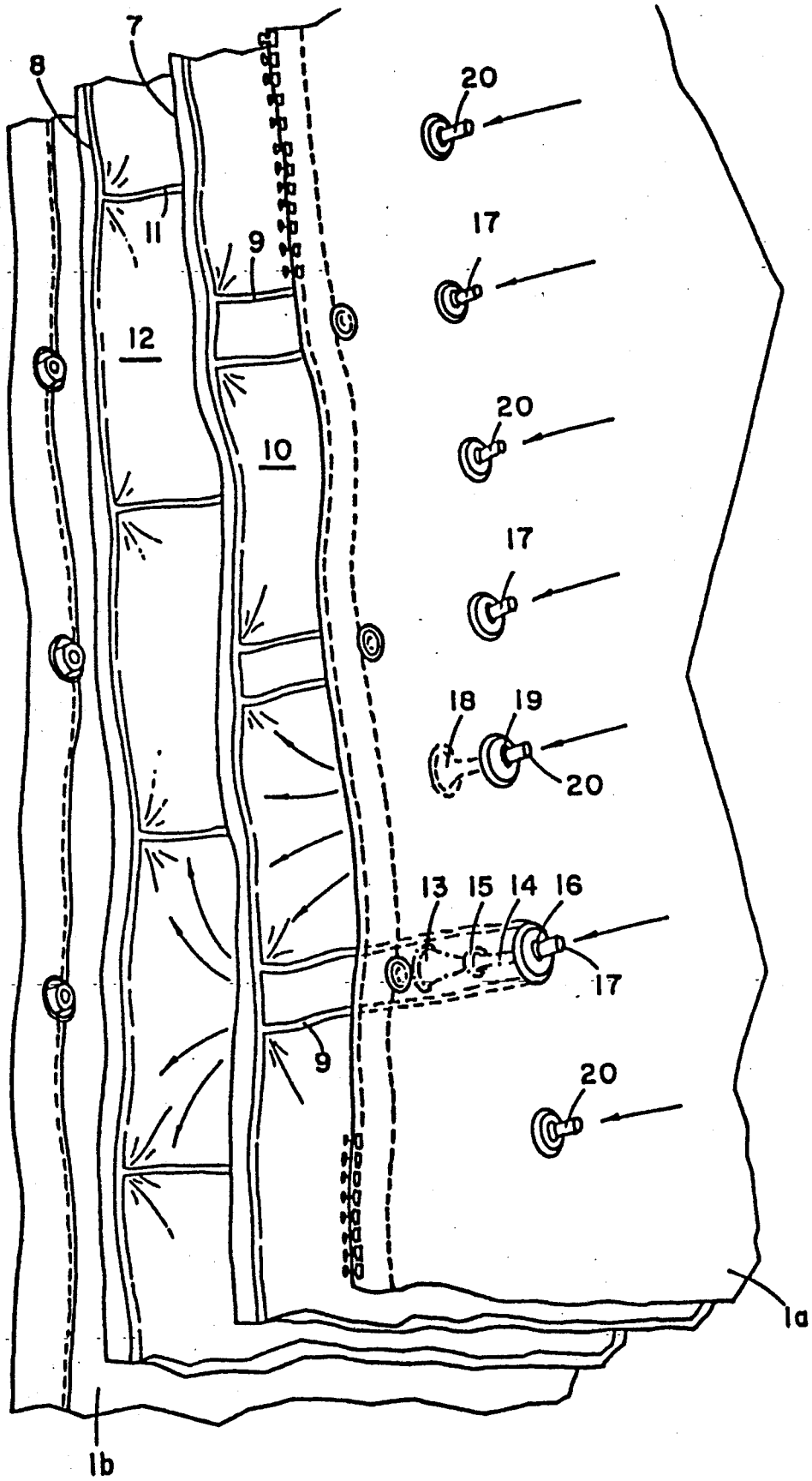
FIG. 2 is an opened up (semi-exploded) view of a portion of the sleeve shown in FIG. 1.

Reference will now be made to FIGS. 1, 2 and 3 of the drawings for a description of an inflatable sleeve in accordance with an aspect of the invention.

The sleeve comprises an outer, flexible envelope 1 consisting of two superimposed layers 1*a* and 1*b*, which are integrally secured together at three of its four sides, 2*a*, 2*b* and 2*c* whilst remaining open at a fourth side 2*d*. Thus, effectively the sleeve 1 forms a pocket which is open at its side 2*d*. The side 2*d* of the layer 1*a* is provided with one constituent set of teeth 3*a* together with a pull tab 3*c* and fastener 3*d* of a slide fastener 3 which extends along the entire length of the side 2*d*. Formed adjacent the opposite side 2*b* of the layer 1*a* are three sets of spaced apart slide fastener teeth 3*e*, 3*f* and 3*g*. The sleeve is furthermore provided with a fastening strip 4 designed to engage a band 5 fitted into the layer 1*a* at the side 2*c* thereof adjacent the side 2*d*. Both the strip 4 and the band 5 are of the interlocking fibrous type (e.g. of "Velcro", reg. T.M.). Press fasteners 6 are provided along the open edges of the side 2*d* allowing these edges to be releasably secured together.

As seen in FIG. 2 of the drawings, there are located within the flexible envelope 1 two pairs of resilient sheets 7 and 8. The constituent sheets of each of the pairs 7 and 8 are bonded together at their juxtaposed longitudinal and transverse edges. The pair of sheets 7 is also bonded together at successive, transversely directed bonding portions 9 which are uniformly spaced apart along the longitudinal extent of the sleeve so as to define transversely directed cells 10. Similarly, the pair of sheets 8 is bonded together at successive, transversely directed bonding portions 11 which are uniformly spaced apart along the longitudinal extent of the sleeve so as to define a second set of transversely directed cells 12. It will be noted that the bonding portions 9 are of substantially greater width than the bonding portions 11 and the bonding portions of one pair of sheets is juxtaposed with respect to the median portions of the cells of the other pair of sheets so that the cells 10 are staggered with respect to the cells 12 and partially overlap each other.

The cells 12 are formed with air inlet ports 13, having tubular connectors 14 which extend through apertures 15 formed in juxtaposed bonding portions 9 and so as to emerge via an aperture 16 formed in the layer 1*a* of the envelope 1 in the form of a coupling nipple 17. The cells 10, on the other hand, are provided with inlet ports 18 which pass directly through apertures 19 formed in the layer 1*a* of the envelope 1 and are coupled to coupling nipples 20.

The sleeve as just described is applied to a body part to be treated (in this case, a leg) so as to be wrapped around the leg. The slide fastener 3 is used to close the sleeve around the leg and, depending on the width of the leg, one or other of the teeth sets 3*e*, 3*f* or 3*g* is used. The sleeve is then firmly retained around the leg by securing the strip 4 firmly on the band 5. The nipples 16, 20 are connected to the output ports of a distributor mechanism (to be described below with reference to FIGS. 4 through 9 of the drawings).

It is an important aspect of the present invention that the sleeve is used in the treatment of a body part (such as, for example, a leg) by the application to the body part of a compression wave which passes along the leg in a direction away from the foot. For this purpose, there is applied to successive groups of cells so as successively to inflat each group whilst, at the same time, at least partially deflating the preceding group.

The progress of such a compressive wave can be seen schematically from FIG. 3 of the drawings, which is a longitudinal sectioned view of internal, flexible sheet pairs of the sleeve. In FIG. 3*a* of the drawings, all the cells are empty and therefore no compressive force is applied to the limb. In FIG. 3*b* of the drawings, successive overlapping cells 12' and 10'' are inflated, whilst the immediately preceding cell 10' is semi-deflated and the immediately succeeding cell 12'' is semi-inflated.

Figure 3A:
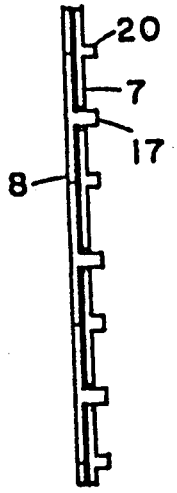
FIGS. 3*a* through 3*d* are schematic, sectional views of the sleeve shown in FIG. 1 taken along the line 3—13.
Figure 3C:
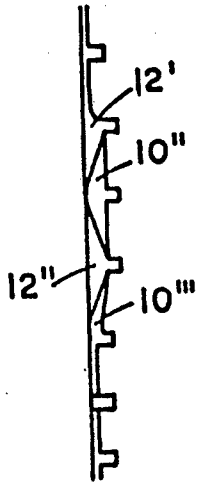
Figure 3B:
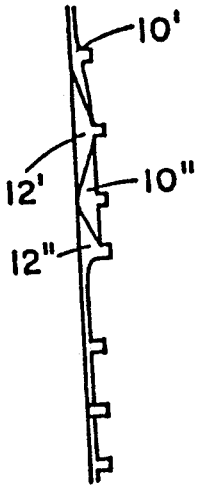
Figure 3D:
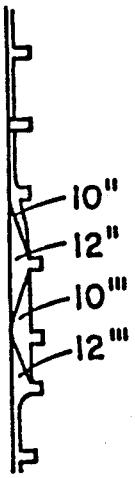

As seen in FIG. 3*c* of the drawings, the cells 10'' and 12'' are now inflated, whilst the immediately preceding cell 12' is partially deflated and the immediately succeeding cell 10''' is partially inflated. As seen in FIG. 3*d* of the drawings, the cells 12'' and 10''' are inflated, whilst the immediately preceding cell 10'' is partially deflated whilst the immediately succeeding cell 12''' is partially inflated. It will thus be seen that at any instant of time during a particular cycle, two succeeding cells are wholly inflated and that an effective compression wave passes along the length of the sleeve.

Reference will now be made on FIGS. 4 through 9 of the drawings for a detailed description of a distributor mechanism employed for transmitting compressed air in the desired sequence to the constituent cells of the sleeve.

Figure 4:
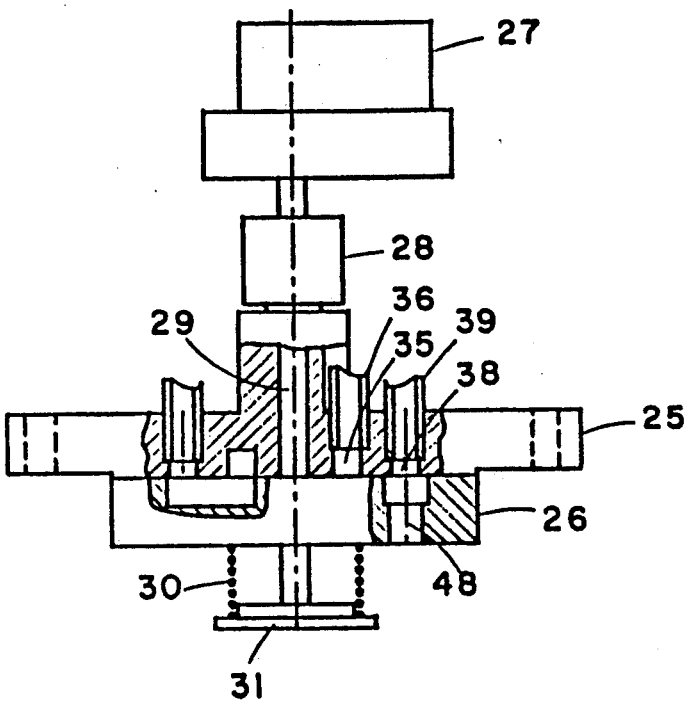
FIG. 4 is a partially sectioned side elevation of a distributor mechanism for use in controlling the inflation of the inflatable sleeve.
Figure 5:
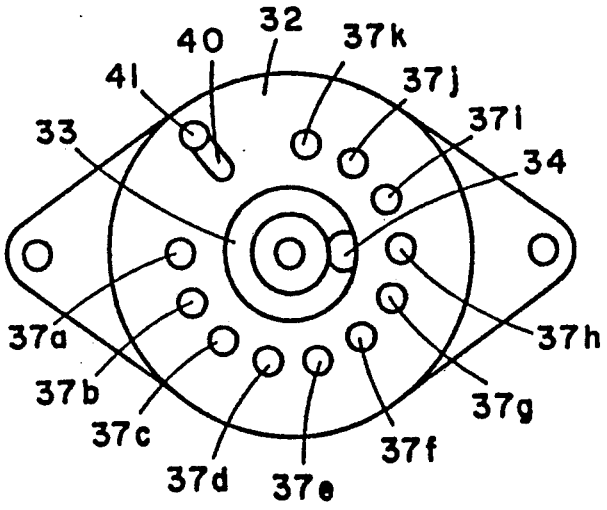
FIG. 5 is a plan view from above of a stator member component of the distributor mechanism shown in FIG. 4.
Figure 6:
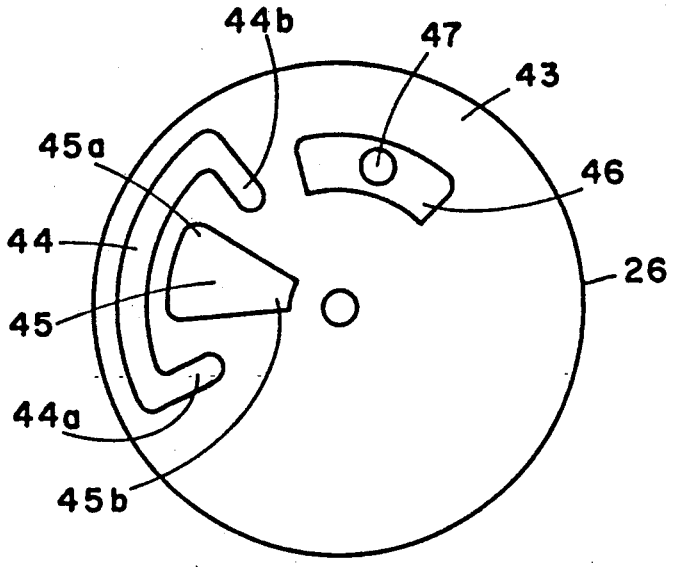
FIG. 6 is a plan view from above of a rotary member component of the distributor mechanism shown in FIG. 4.

As seen in FIG. 4, the distributor mechanism comprises a stator member 25 and a rotary member 26. A gear drive motor 27 is coupled via a suitable coupling 28 to a drive axle 29, the stator member 25 serves rotatively to drive the rotary member 26. The stator and rotary members 25 and 26 are held together by means of a compression spring 30 which bears at one end on the rotary member 26 and at the other end on an abutment member 31.

Formed on a planar face 32 of the stator member 25 is a centrally located pressure groove 33 in which is formed a pressure inlet aperture 34 which communicates with a pressure inlet port 35 which, in its turn, communicates via ducting 36 with a compressor (not shown). Surrounding the pressure groove 33 is a circularly disposed array of outlet apertures 37A to 37K, which communicate in their turn, respectively, with a corresponding number of outlet ports 38, coupled by means of ducting 39 with the respective cells A–K of the sleeve (seen in FIG. 1). Also formed in the face 32 of the stator 35 adjacent the aperture 37A is a drainage groove 40 which communicates with a drainage aperture 41. Formed in a planar face 43 of the rotary member 26, which planar face 43 is designed to be juxtaposed with respect to the planar face 32 of the stator member 25, is an arc-like by-pass groove 44 having a pair of inwardly directed terminal portions 44*a* and 44*b* and a pressure distributor groove 45 which is broader at its outer end 45*a* than at its inner end 42*b*. Also formed in the face 43 of the rotary member 26 is an arc-shaped drainage groove 46 having formed centrally therein a venting aperture 47 which communicates with a venting portion 48. The juxtaposed space 43 and 32 defined between them a central stationary pressure chamber comprising the pressure groove 33 and a rotary distributor chamber comprising the distributor groove 45.

Figure 9:
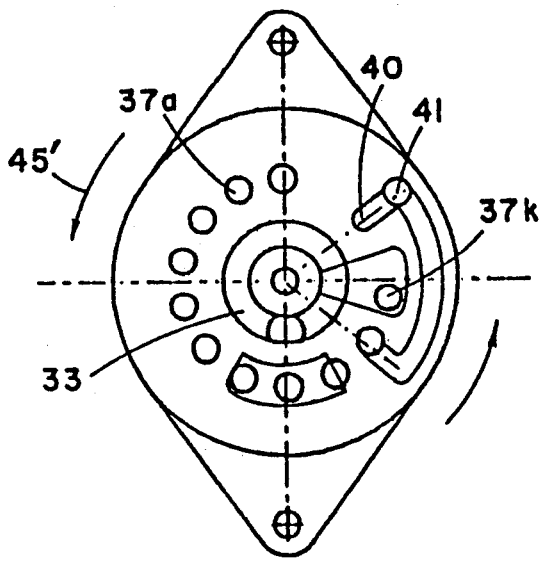
FIGS. 7, 8 and 9 are plan views from above of the stator member component shown in FIG. 5, there being superimposed thereon the groove structure of the rotary member component shown in FIG. 6 in respectively differing rotary positions.
Figure 8:
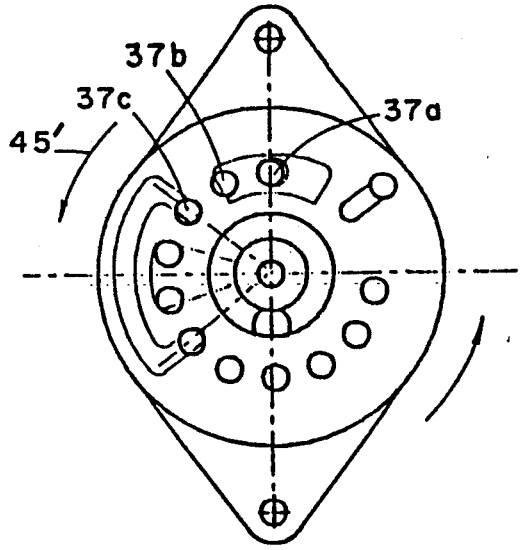
Figure 7:
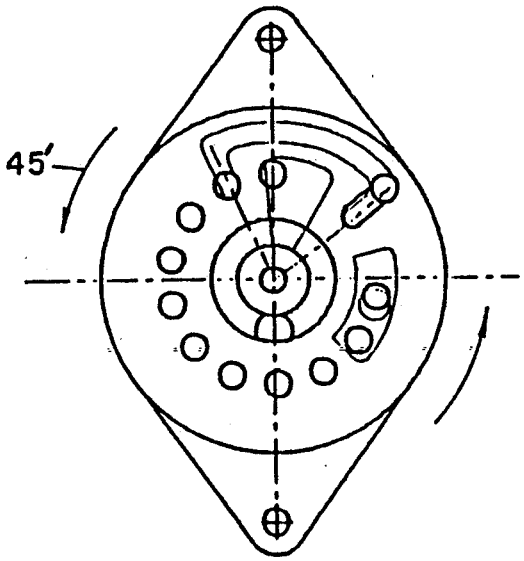

Reference will now be made to FIGS. 7, 8 and 9 of the drawings for a description of the mode of operation of the distributor mechanism in ensuring sequential inflation of successive pairs of cells of the sleeve, accompanied by sequential deflation of immediately preceding cell pairs. As seen in FIG. 7 of the drawings, with the rotation of the rotary member 26 with respect to the stator member 25 in the direction of the arrows 45, the pressure distribution groove 45 places the aperture 37A in communication with the pressure groove 33 and, as a consequence, the sleeve cell A coupled to this aperture 37A is inflated. With the continued rotation of the rotary member 26, the next aperture 37B is placed in communication with the pressure groove 33 whilst the first aperture 37A is still in such communication and, as a result, the next cell B of the pressure sleeve is also inflated. Thus, we now have a situation where the first two cells of the sleeve are simultaneously inflated. With the continued rotation of the rotary member, the distribution groove 45 communicates with apertures 37B and 37C, with the consequence that the second and third cells B and C of the sleeve are simultaneously inflated, but at the same time the bypass groove 44 places the aperture 37A into the communication with the aperture 37D, as a consequence of which compressed air passes from the first cell A to the fourth cell D, partially inflating the latter. The continued rotation of the rotary member results in the apertures 37C and 37D being placed in communication with the distribution groove, and the consequent inflation of the third and fourth cells C and D of the sleeve. At the same time, the by-pass groove brings into communication the aperture 37B and 37E, with the consequence that air passes from the second to the fifth cells B and E, partially inflating the fifth cell E. At the same time the venting groove 46 comes into communication with the aperture 37A and, as a consequence, the first cell A of the sleeve is vented, thereby deflating this cell A. This procedure continues and, for example, as shown in FIG. 8 of the drawings, apertures 37D and 37E are in communication with the pressure groove 45 and, as a consequence the fourth and fifth cells D and E of the sleeve are inflated. Air from the third cell C of the sleeve passes through the by-pass groove 44 to the sixth cell F of the sleeve, partially inflating the latter and, at the same time, the first and second cells A and B of the sleeve are completely vented via the venting groove 46 and are in consequence wholly deflated.

Thus, with the continued rotation of the rotary member all cells A–K of the sleeve are successively inflated and deflated and, in the position shown in FIG. 9 of the drawings, the final two apertures 37J and 37K, having been previously placed in communication with the pressure distribution groove 45 with the consequent inflation of the final two cells J and K of the sleeve are then vented. The aperture 37J is vented by being placed in communication with the by-pass groove 44 which is itself in communication with the venting aperture 41. The final aperture 37K is vented by being placed in communication via the pressure distribution groove 45 with the venting groove 40 and the venting aperture 41.

Thus, it is ensured that at the end of the cycle involving the successive inflation and deflating of successive pairs of cells, all cells are simultaneously deflated and the deflated condition of the cells continues for a period of time corresponding to the time required for the pressure distribution groove 45 to move from communication with the final aperture 37K to communication with the initial aperture 37A.

Thus, to sum up the operation of the distributor mechanism in ensuring the successive inflation and deflation of pairs of cells, each cycle of operations results in that, at any particular instant of time during a cycle, two successive cells of a sleeve are inflated. Furthermore, by virtue of the provision of the by-pass groove 44, the deflation of a cell immediately upstream of the pair of inflated cells is accompanied by the partial inflation of a cell immediately downstream from the pair of inflated cells. This utilisation of the air of an upstream cell for the partial inflation of a downstream cell carries with it an economy in energy requirements in operation of the compressor. Furthermore, by virtue of the fact that in the distribution of the outlet apertures 37A through 37K in the stator member, a significant annular gap is provided between the first aperture 37A and the final aperture 37K, there is ensured a significant time interval between inflation cycles, during which interval all cells of the sleeve are simultaneously deflated. Thus, the application of the compression wave to the patient takes place in successive cycles which are spaced apart in time, thereby ensuring that the patient is not subjected to continuous compression waves which could be deleterious. Furthermore, the fact that at no instant in time is the patient subjected to compression caused by the total inflation of more than two cells, allows for the application of significantly higher compression pressures than would otherwise be tolerated.

Thus, for example, the use of the equipment in accordance with the invention and as described above, in the treatment of patients with oedema, can involve the use of a pressure wave which can reach a maximum pressure of 200 mm Hg. Each cycle can have a duration of 30 seconds of which 26 seconds can involve inflation and 4 seconds deflation. The intervals between successive cycles during which no pressure whatsoever is applied to the limb can then be 30 seconds.

Figure 10:
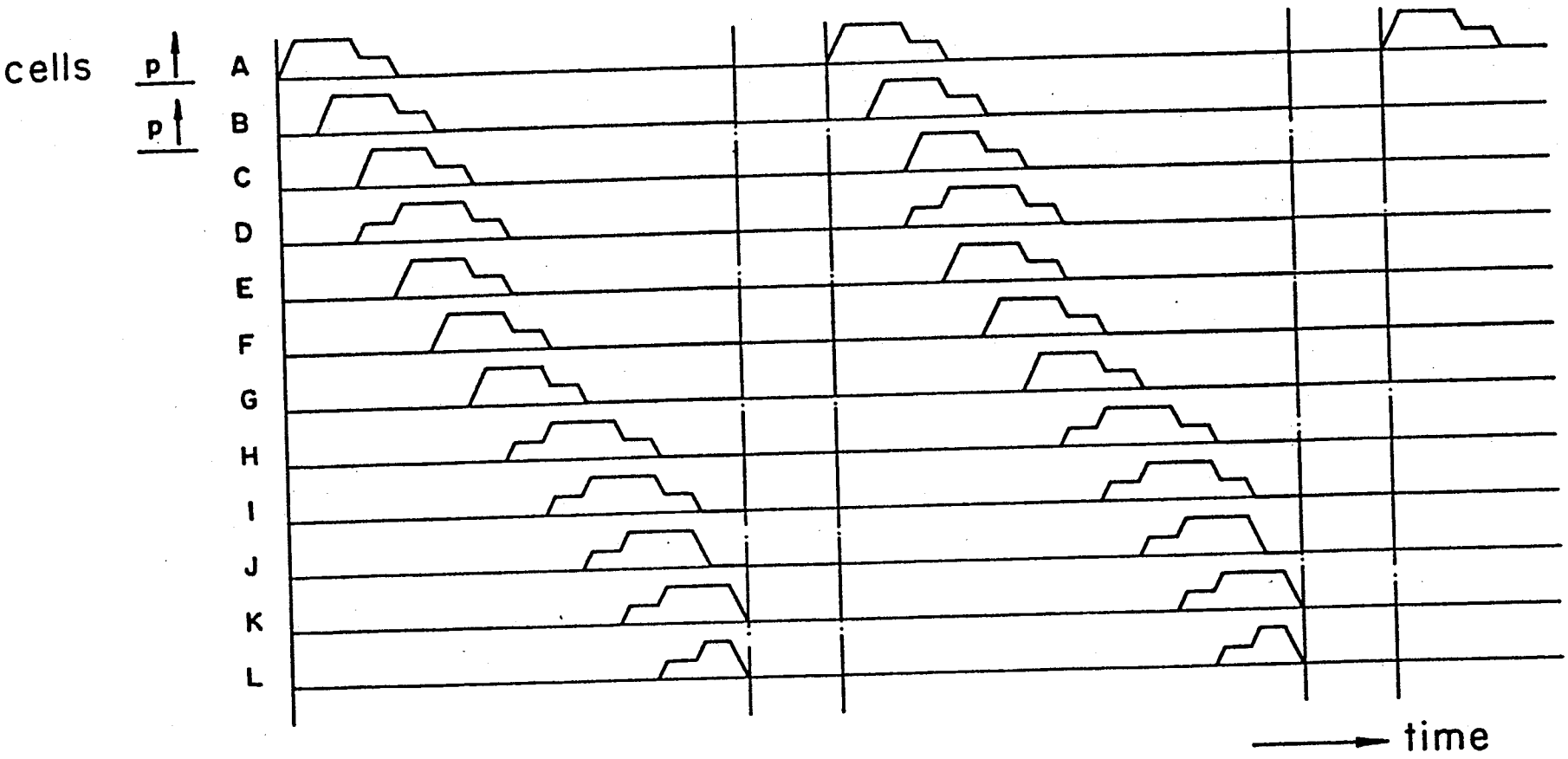
FIG. 10 illustrates the sequence of inflation and deflation produced by the distributor mechanism construction as shown in FIGS. 4 through 9.

The operation of the distributor mechanism in effecting the successive inflation of the cells of the sleeve can be schematically understood from FIG. 10 of the drawings, wherein the successive inflation of cells A through K is shown as a function of time and wherein it can be clearly seen that the total inflation of cells A through I are followed initially by the partial deflation thereof prior to the total deflation, whilst the total inflation of cells D through K are preceded initially by the partial inflation thereof, which partial inflation results from the partial deflation of an upstream cell.

We claim:

1. A method of treating a body part by applying an intermittent compression thereto using for this purpose an inflatable sleeve divided into n successively overlapping inflatable cells extending along one dimension of the sleeve wherein $n>6$ comprising the steps of:

applying said sleeve to said body part of enclose same with said inflatable cells extending along one dimension of the sleeve; and applying cyclically a pressurized fluid to successive groups of cells, wherein each group comprises m successive cells wherein $1 \leqq m \leqq 2$, so as successively to inflate each group whilst, at the same time, at least partially deflating the preceding group, and ensuring simultaneous deflation of all cells for a minimal time period between successive cycles.

2. A method according to claim 1 and furthermore comprising the step of at least partially deflating at least some of the cells by placing the cell to be deflated, being immediately upstream of the group being inflated, into communication with the cell immediately downstream of the group being inflated.

3. A method according to claim 2 and furthermore comprising the step of venting each cell subsequent to its having been placed into said communication.

4. A distributor for use in treating a body part comprising stationary and rotary members having respective first and second juxtaposed, substantially planar surfaces, said first planar surface being grooved so as to define with said second planar surface a stationary pressure chamber;

a pressurized fluid inlet port formed in said stationary member and communicating with said pressure chamber;

a plurality of pressurized fluid outer ports formed in said stationary member so as to surround said stationary pressure chamber;

said second planar surface being grooved so as to define, with said first planar surface;

a rotary distributor chamber which communicates, at an inner end thereof, with said pressure chamber and, at an outer portion thereof, with successive outer ports;

a by-pass chamber serving to effect communication between an outlet port immediately outside a downstream edge of said distributor chamber and an outlet port immediately outside an upstream edge of said distributor chamber; and a venting chamber communicating with a venting port formed in said rotary member and adapted to communicate successively with each outlet port subsequent to their communication with said by-pass chamber.

5. A distributor according to claim 4 wherein said first planar surface is grooved so as to define with said second planar surface a drainage channel which communicates with a drainage port formed in said stationary member.

6. An inflatable sleeve of flexible material for the treatment of body parts and divided into a plurality of internal inflatable cells extending along one dimension of the sleeve, each of said cells including a port for inletting and outletting fluid with respect thereto, thereby to individually inflate or deflate the cells; the sleeve being applicable to the body part to be treated to enclose same with the inflatable cells extending annularly around the sleeve.

characterized in that said sleeve comprises an outer flexible envelope and first and second pairs of resilient sheets located within said envelope, the component sheets of each pair being bonded together at successive, transversely directed bonding portions which are uniformly spaced apart along the longitudinal extent of the sleeve so as to define first and second sets of transversely directed cells formed respectively between said first and second pairs of sheets, said first set being staggered with respect to said second set so as partially to overlap said second set; each cell being provided with a tubular connector extending from the cell port, the tubular connectors of the first set extending directly through said envelope whilst the tubular connectors of the second set extend through said envelope via respective bonded portions of the first pair of sheets, the tubular connectors of said first and second sets respectively alternating with each other.

* * * * *